US007295180B2

(12) United States Patent
Ichikawa et al.

(10) Patent No.: US 7,295,180 B2
(45) Date of Patent: Nov. 13, 2007

(54) BACKLIGHT DRIVING DEVICE, BACKLIGHT DRIVING METHOD, AND LIQUID CRYSTAL DISPLAY DEVICE

(75) Inventors: Hiroaki Ichikawa, Kanagawa (JP); Kenichi Kikuchi, Kanagawa (JP); Kimio Hatajiri, Kanagawa (JP)

(73) Assignee: Sony Corporation (JP)

( * ) Notice: Subject to any disclaimer, the term of this patent is extended or adjusted under 35 U.S.C. 154(b) by 166 days.

(21) Appl. No.: 11/281,153

(22) Filed: Nov. 17, 2005

(65) Prior Publication Data

US 2006/0109389 A1 May 25, 2006

(30) Foreign Application Priority Data

Nov. 19, 2004 (JP) ..... 2004-336571
Aug. 25, 2005 (JP) ..... 2005-244924

(51) Int. Cl.
*G09G 3/36* (2006.01)
*H05B 37/02* (2006.01)

(52) U.S. Cl. ..... 345/102; 345/83; 345/88; 315/308

(58) Field of Classification Search ..... 345/76, 345/77, 82, 83, 87, 88, 102; 315/291, 309, 315/308

See application file for complete search history.

(56) References Cited

U.S. PATENT DOCUMENTS 6,621,482 B2 * 9/2003 Fuller ..... 345/102
7,199,771 B2 * 4/2007 Yamazaki et al. ..... 345/84

FOREIGN PATENT DOCUMENTS

JP 2001-272938 10/2001

* cited by examiner

*Primary Examiner*—Thuy Vinh Tran
(74) *Attorney, Agent, or Firm*—Lerner, David, Littenberg, Krumholz & Mentlik, LLP

(57) ABSTRACT

A backlight driving device for controlling driving of a backlight device for display, the backlight device generating predetermined white light by mixing light from a plurality of light emitting diodes of three or more colors, the backlight driving device including: storing device for storing an initial amount of current and a predetermined multiplication coefficient for each color; light quantity detecting device for detecting a light quantity for each color; and controlling device for adjusting an amount of current passed through the light emitting diodes of each color by feedback control on a basis of a detection output from the light quantity detecting device with an amount of current obtained by multiplying the initial amount of current by the predetermined multiplication coefficient as an initial value, whereby the predetermined white light is generated; wherein when a difference between the amount of current after the feedback control and the initial amount of current exceeds a predetermined threshold value, the controlling device updates the multiplication coefficient according to the amount of current after the feedback control.

8 Claims, 6 Drawing Sheets

BACKLIGHT DRIVING DEVICE, BACKLIGHT DRIVING METHOD, AND LIQUID CRYSTAL DISPLAY DEVICE

CROSS-REFERENCES TO RELATED APPLICATIONS

The present invention contains subject matter related to Japanese Patent Application 2004-336571 field in the Japanese Patent Office on Nov. 19, 2004 and Japanese Patent Application 2005-244924 filed in the Japanese Patent Office on Aug. 25, 2005, the entire contents of which being incorporated herein by reference.

BACKGROUND OF THE INVENTION

The present invention relates to a backlight driving device, a backlight driving method, and a liquid crystal display device that control driving of a backlight device including LED (Light Emission Diode) elements.

While a CCFL (Cold Cathode Fluorescent Lamp) type backlight using a fluorescent tube is mainstream as a backlight source for a liquid crystal panel, there has been a demand for the backlight to be free of mercury in consideration of the environment. For this reason, LEDs have recently been considered promising as a light source to supersede the CCFL. A method of using the primary colors of red LEDs, green LEDs, and blue LEDs individually and obtaining white light by optical synthetic additive color mixing, in particular, has been considered actively to be used for television purposes because the method facilitates attaining a color balance.

When LEDs are used as a light source of a backlight, luminous efficiencies of red LEDs, green LEDs, and blue LEDs are different, and therefore a current flowing through an LED of each color needs to be independent of the other colors. Since an LED used for each color is different in semiconductor composition, element voltage is different for each color, and thus power consumption is different for each color. Also, when LEDs are used as a light source of a backlight, it is not possible to drive each LED separately from a practical viewpoint of cost (see Japanese Patent Laid-open No. 2001-272938).

Therefore, when LEDs are used as a light source of a backlight, a method of cascading a certain number of LEDs (series connection) and driving the LEDs en bloc is used.

Specifically, a method is used in which a DC-to-DC converter power supply and a PWM (Pulse Width Modulation) control unit are provided for each cascaded group of LEDs as a load, for example each cascaded group of a predetermined number of LEDs for each color of red, green, and blue. Photosensors for red, green, and blue detect light quantities of the respective colors, and an amount of current flowing through each group of LEDs is subjected to PWM adjustment by feedback control on the basis of a result of the detection to thereby adjust chromaticity and brightness resulting from a synthesis of red, green, and blue.

SUMMARY OF THE INVENTION

However, when response of such feedback control is fast, chromaticity is changed frequently, which is easily perceived visually by a user. In order to avoid inconveniences of such frequent change in chromaticity, the response of the feedback control is usually set slow. Therefore the adjustment of chromaticity by such feedback control at the time of turning on power cannot be expected.

Thus, in a backlight having such LEDs as a light source, an amount of power serving as a reference for obtaining predetermined white light is initially set for each color before shipment from a factory, for example. This initial setting is for example performed by roughly setting a duty ratio and a peak value (the value of a constant current flowing through LEDs of each group) for LEDs of each color, making the duty ratio and the peak value variable and adjusting the duty ratio and the peak value so as to attain a desired light quantity and a desired chromaticity, and storing the duty ratio of the LEDs of each color, an output of the photosensor for each color, and an output of a temperature sensor in a nonvolatile memory.

Thus, since the duty ratio serving as a reference is set in advance, predetermined white light can be obtained by reading this duty ratio from the nonvolatile memory at a time of turning on power.

However, LEDs are devices that degrade in brightness with time. In addition, speed of degradation varies not only between LEDs of different colors but also between LEDs of a same color, depending on variations at the time of manufacturing, the temperature of the LEDs, the ambient temperature of an environment in which the backlight is disposed, and the like.

Hence, when the brightness is greatly degraded, a time (converging time) required to read the above-described reference value from the nonvolatile memory after power is turned on and obtain predetermined white light by adjusting the duty ratio of the LEDs of two colors is lengthened. As a result, a phenomenon occurs in which the screen is reddish at the time of turning on power and thereafter gradually becomes white, for example. In addition, when the duty ratio of the LEDs is increased because of a degradation in brightness, a phenomenon occurs in which power consumption of the backlight is increased as compared with an initial setting.

Incidentally, this problem is true not only for degradation in brightness with time as described above but also for a case where variations in characteristics of the LEDs occur due to insufficient annealing or the like and a difference between the duty ratio at the time of initial setting and the duty ratio after adjustment becomes great.

The present invention is proposed in view of such conventional actual situations, and it is desirable to provide a backlight driving device, a backlight driving method, and a liquid crystal display device that can prevent the time required to converge chromaticity from being lengthened due to secular change or the like when predetermined white light is obtained by adjusting an amount of current flowing through LEDs by feedback control.

According to an embodiment of the present invention, there is provided a backlight driving device for controlling driving of a backlight device for display, the backlight device generating predetermined white light by mixing light from a plurality of light emitting diodes of three or more colors, the backlight driving device including: storing means for storing an initial amount of current and a predetermined multiplication coefficient for each color; light quantity detecting means for detecting a light quantity for each color; and controlling means for adjusting an amount of current passed through the light emitting diodes of each color by feedback control on a basis of a detection output from the light quantity detecting means with an amount of current obtained by multiplying the initial amount of current by the predetermined multiplication coefficient as an initial value, whereby the predetermined white light is generated; wherein when a difference between the amount of current after the feedback control and the initial amount of current exceeds a predetermined threshold value, the controlling means updates the multiplication coefficient according to the amount of current after the feedback control.

In addition, according to an embodiment of the present invention, there is provided a backlight driving method for controlling driving of a backlight device for display, the backlight device generating predetermined white light by mixing light from a plurality of light emitting diodes of three or more colors, the backlight driving method including: a reading step for reading an initial amount of current and a predetermined multiplication coefficient stored for each color from storing means; a light quantity detecting step for detecting a light quantity for each color; a controlling step for adjusting an amount of current passed through the light emitting diodes of each color by feedback control on a basis of a detection output in the light quantity detecting step with an amount of current obtained by multiplying the initial amount of current by the predetermined multiplication coefficient as an initial value, whereby the predetermined white light is generated; and an updating step for updating the multiplication coefficient according to the amount of current after the feedback control when a difference between the amount of current after the feedback control and the initial amount of current exceeds a predetermined threshold value.

Further, according to an embodiment of the present invention, there is provided a liquid crystal display device including: a backlight device for generating predetermined white light by mixing light from a plurality of light emitting diodes of three or more colors, the backlight device being driven by a backlight driving device; and a transmissive type color liquid crystal display panel irradiated with the white light generated by the backlight device from a back side of the transmissive type color liquid crystal display panel; wherein the backlight driving device includes storing means for storing an initial amount of current and a predetermined multiplication coefficient for each color, light quantity detecting means for detecting a light quantity for each color, and controlling means for adjusting an amount of current passed through the light emitting diodes of each color by feedback control on a basis of a detection output from the light quantity detecting means with an amount of current obtained by multiplying the initial amount of current by the predetermined multiplication coefficient as an initial value, whereby the predetermined white light is generated, and when a difference between the amount of current after the feedback control and the initial amount of current exceeds a predetermined threshold value, the controlling means updates the multiplication coefficient according to the amount of current after the feedback control.

According to the present invention, an amount of current passed through the light emitting diodes of each color is adjusted by feedback control with an amount of current obtained by multiplying the initial amount of current stored in the storing means by the predetermined multiplication coefficient as an initial value, whereby the predetermined white light is generated. In particular, when a difference between the amount of current after the feedback control and the initial amount of current exceeds a predetermined threshold value, the multiplication coefficient is updated according to the amount of current after the feedback control. It is therefore possible to prevent the time required to converge chromaticity from being lengthened even when the light emitting diodes is degraded in brightness due to secular change or the like.

DETAILED DESCRIPTION

A concrete embodiment to which the present invention is applied will hereinafter be described in detail with reference to the drawings.

Figure 1:
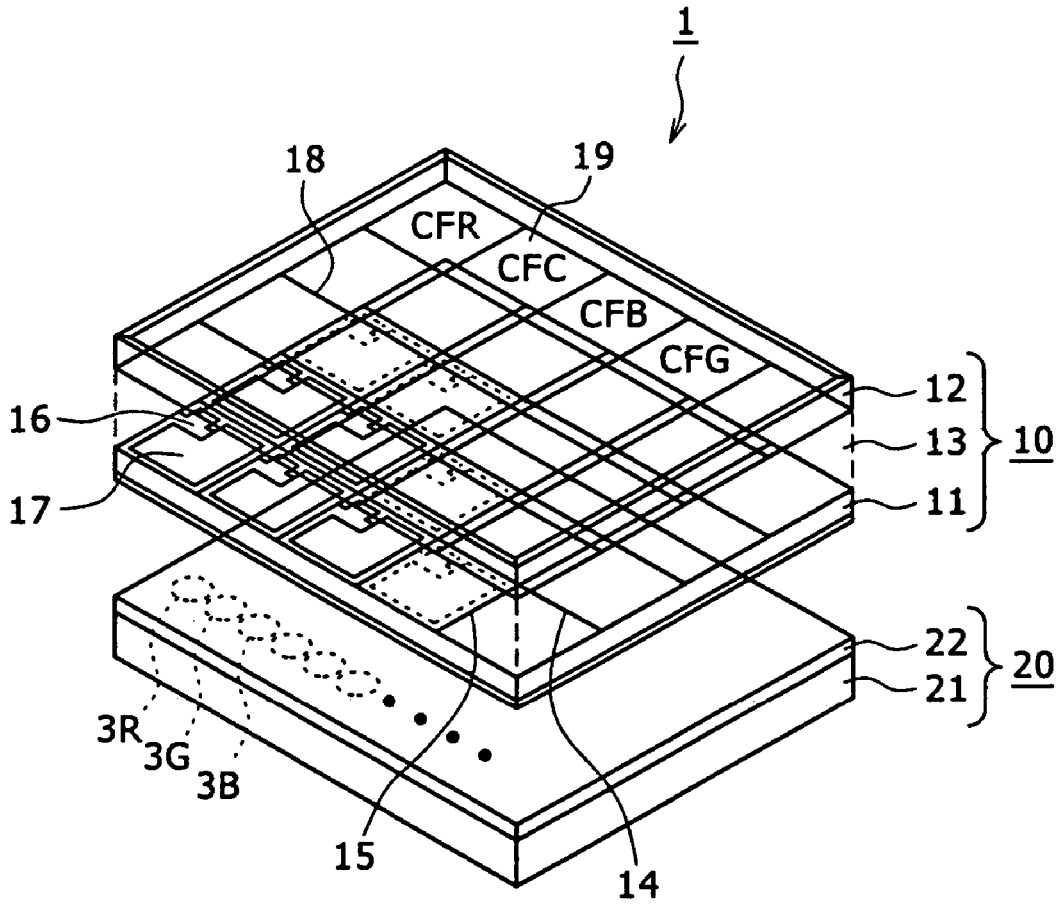
FIG. 1 is a schematic perspective view of a configuration of a backlight type liquid crystal display unit in a color liquid crystal display device to which the present invention is applied.

The present invention is for example applied to a color liquid crystal display device having a backlight type liquid crystal display unit 1 formed as shown in FIG. 1.

The liquid crystal display unit 1 includes a transmissive type color liquid crystal display panel 10 and a backlight device 20 disposed on a back side of the color liquid crystal display panel 10.

The transmissive type color liquid crystal display panel 10 is formed by arranging a TFT substrate 11 and a counter electrode substrate 12 such that the TFT substrate 11 and the counter electrode substrate 12 are opposed to each other, and providing a liquid crystal layer 13 formed by filling for example a twisted nematic (TN) liquid crystal into a gap between the TFT substrate 11 and the counter electrode substrate 12. Formed on the TFT substrate 11 are signal lines 14 and scanning lines 15 arranged in the form of a matrix, thin-film transistors 16 as switching elements arranged at intersections of the signal lines 14 and the scanning lines 15, and pixel electrodes 17. The thin-film transistors 16 are sequentially selected by the scanning lines 15, and writes video signals supplied from the signal lines 14 to the corresponding pixel electrodes 17. Counter electrodes 18 and color filters 19 are formed on an inner surface of the counter electrode substrate 12.

In the color liquid crystal display unit 1, the thus formed transmissive type color liquid crystal display panel 10 is interposed between two polarizers. The color liquid crystal display unit 1 provides a desired full-color video display by driving the transmissive type color liquid crystal display panel 10 by an active matrix system with the transmissive type color liquid crystal display panel 10 irradiated with white light from the back side by the backlight device 20.

The backlight device 20 has a light source 21 and a wavelength selecting filter 22. The backlight device 20 illuminates the color liquid crystal display panel 10 with light emitted from the light source 21 via the wavelength selecting filter 22 from the back side of the color liquid crystal display panel 10. Such a backlight device 20 is disposed on the back side of the transmissive type color liquid crystal display panel 10, and is a direct backlight type that illuminates the color liquid crystal display panel 10 directly from under the back side of the color liquid crystal display panel 10.

The light source 21 of the backlight device 20 has a large number of light emitting diodes (LED: Light Emitting Diode) 3. The light source 21 outputs light emitted from the light emitting diodes. The light source 21 has a large number of light emitting diodes 3R emitting red (R) light, a large number of light emitting diodes 3G emitting green (G) light, and a large number of light emitting diodes 3B emitting blue (B) light. The light source 21 generates white light by mixing the R, G, and B light, and emits this white light to the color liquid crystal display panel 10.

The arrangement of light emitting diodes 3 in the light source 21 of the backlight device 20 is as follows, for example.

Figure 2:
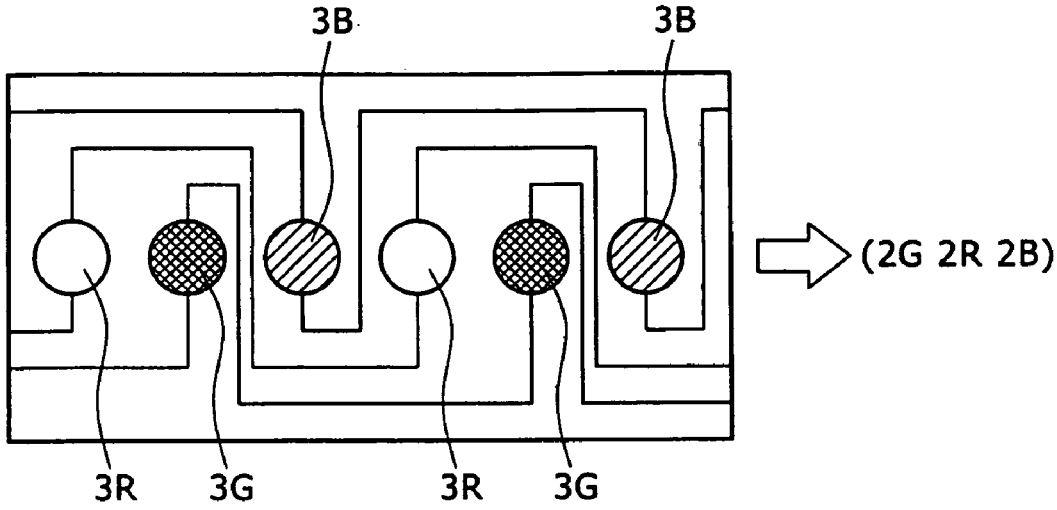
FIG. 2 is a diagram schematically showing a unit cell in which two red light emitting diodes, two green light emitting diodes, and two blue light emitting diodes are used and the six light emitting diodes in total are arranged in one row, with a pattern notation using the number of light emitting diodes for each color.
Figure 3:
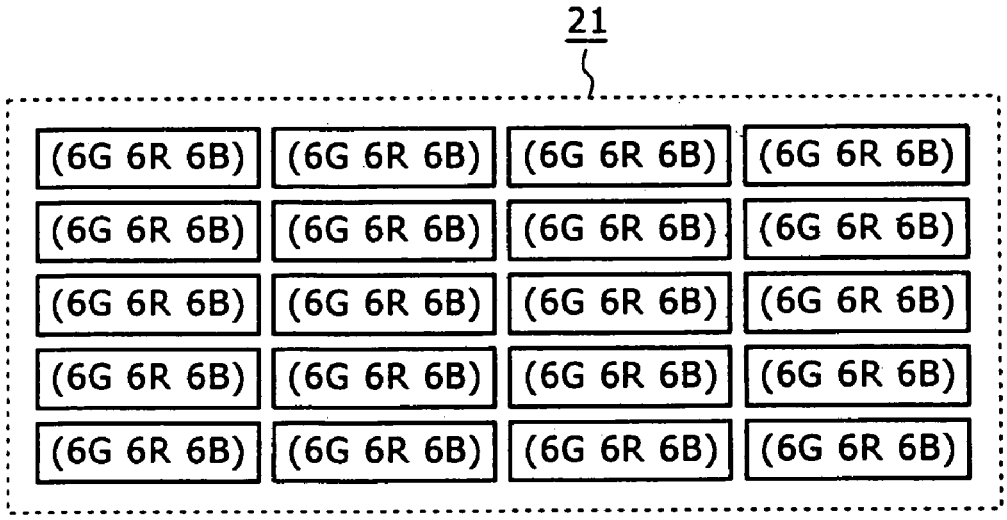
FIG. 3 is a diagram schematically showing an example of connection of actual light emitting diodes in a light source of a backlight device forming the color liquid crystal display device.

First, as shown in FIG. 2, two red light emitting diodes 3R, two green light emitting diodes 3G, and two blue light emitting diodes 3B are used, and an arrangement in a row of the six light emitting diodes in total is formed as a unit cell (2G 2R 2B). Next, a medium unit (6G 6R 6B) is formed by further arranging three unit cells (2G 2R 2B) in a horizontal direction. Then, as shown in FIG. 3, such medium units (6G 6R 6B) are connected in series with each other in the horizontal direction, and the light emitting diodes 3 connected in series with each other are arranged in a vertical direction so as to cover the entire screen.

By thus arranging the light emitting diodes 3, the three colors R, G, and B of the light emitting diodes are mixed with each other to emit well-balanced white light. Incidentally, the arrangement of the light emitting diodes 3 is not limited to the arrangements shown in FIG. 2 and FIG. 3, and any arrangement will do as long as colors are mixed with each other in a well-balanced manner. The light emitting diodes 3 are not limited to light emitting diodes of the three colors R, G, and B, and light emitting diodes of more colors may be used to produce a white color of a predetermined chromaticity.

Figure 4:
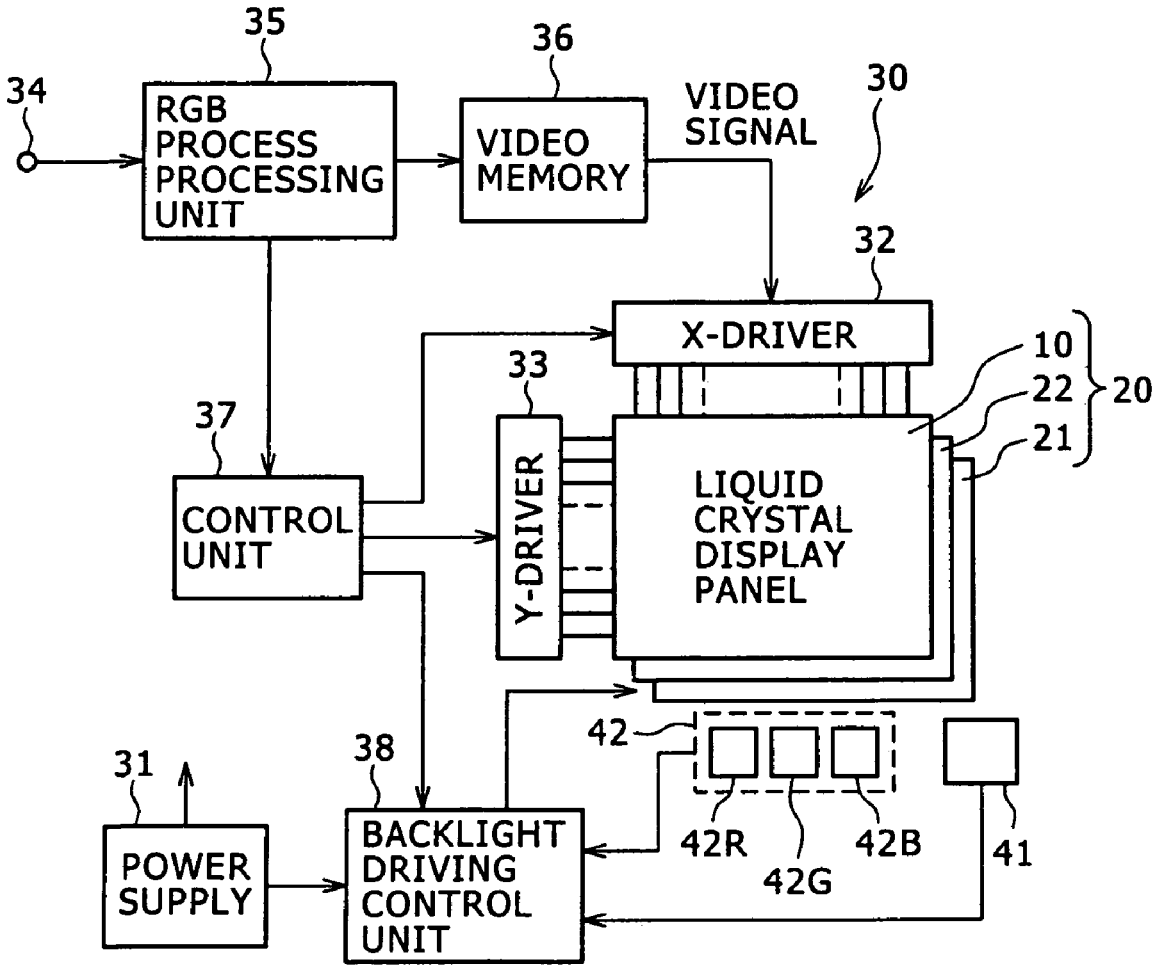
FIG. 4 is a block diagram showing an example of general configuration of a color liquid crystal display device.

FIG. 4 shows an example of general configuration of a color liquid crystal display device 30.

This color liquid crystal display device 30 includes: a power supply unit 31 for supplying power for driving a color liquid crystal display panel 10 and a backlight device 20; an X-driver circuit 32 and a Y-driver circuit 33 for driving the color liquid crystal display panel 10; an RGB process processing unit 35 externally supplied with a video signal via an input terminal 34; a video memory 36 and a control unit 37 connected to the RGB process processing unit 35; and a backlight driving control unit 38 for driving control of the backlight device 20.

A video signal input via the input terminal 34 is subjected to a signal process such as a chroma process and the like by the RGB process processing unit 35, and further converted from a composite signal into RGB separate signals suitable for driving the color liquid crystal display panel 10. The RGB separate signals are supplied to the control unit 37, and also supplied to the X-driver 32 via the video memory 36. The control unit 37 controls the X-driver 32 and the Y-driver circuit 33 in predetermined timing according to the RGB separate signals, and drives the color liquid crystal display panel 10 by the RGB separate signals supplied to the X-driver 32 via the video memory 36, whereby video corresponding to the RGB separate signals is displayed.

Figure 5:
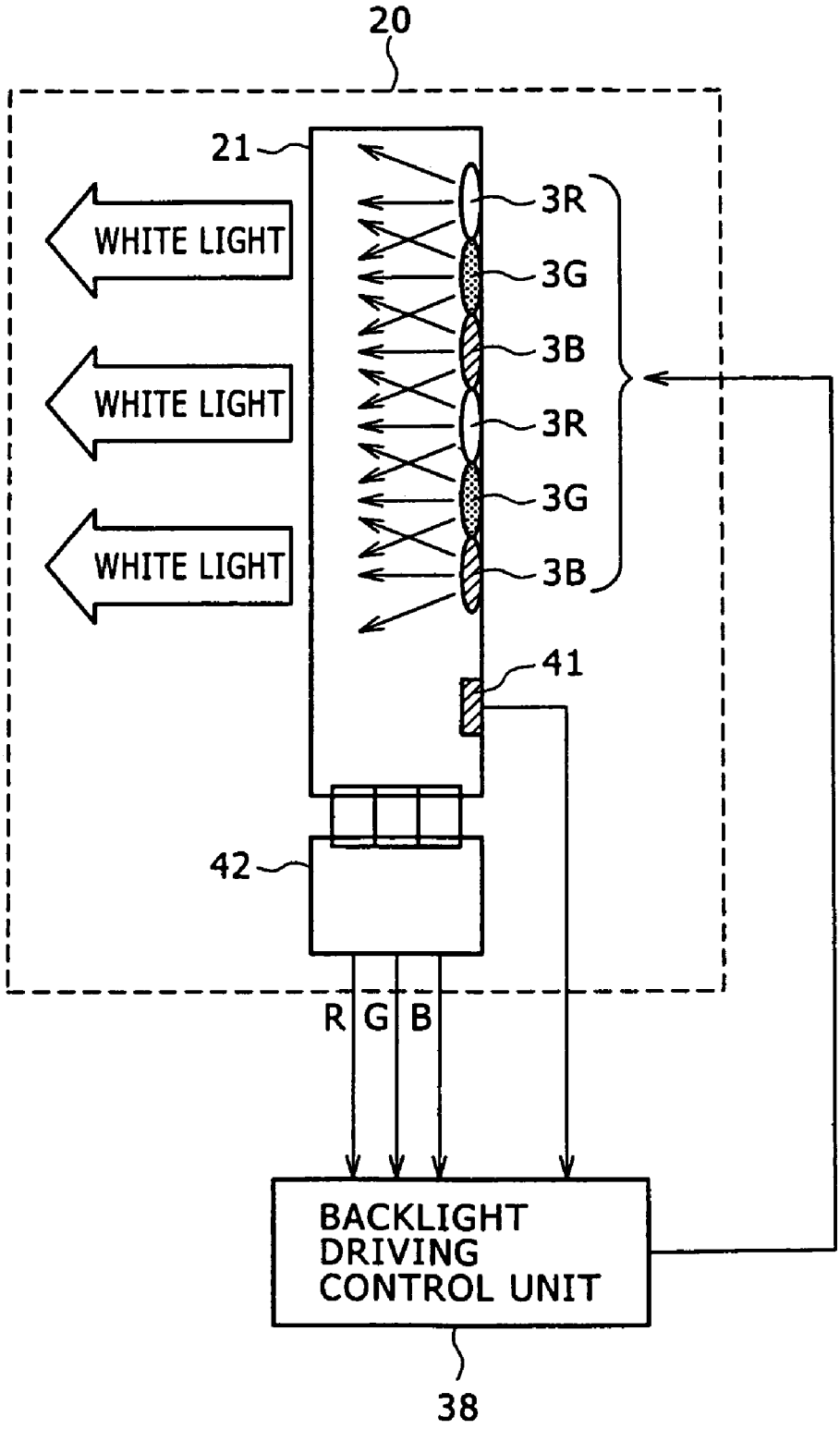
FIG. 5 is a diagram schematically showing a temperature sensor and a light quantity or chromaticity sensor provided in the backlight device.

As shown in FIG. 4 and FIG. 5, the color liquid crystal display device 30 includes: a temperature sensor 41 for detecting the temperature of the light source 21 (light emitting diodes) of the backlight device 20; and a light quantity or chromaticity sensor 42 (42R, 42G, and 42B) for detecting the light quantity or chromaticity of the colors R, G, and B of the light source 21 (light emitting diodes) in the backlight device 20.

A detected value of the temperature sensor 41 and a detected value of the light quantity or chromaticity sensor 42 are supplied to the backlight driving control unit 38. The backlight driving control unit 38 controls driving current for driving the light emitting diodes forming the light source 21 on the basis of the detected values of these sensors.

Figure 6:
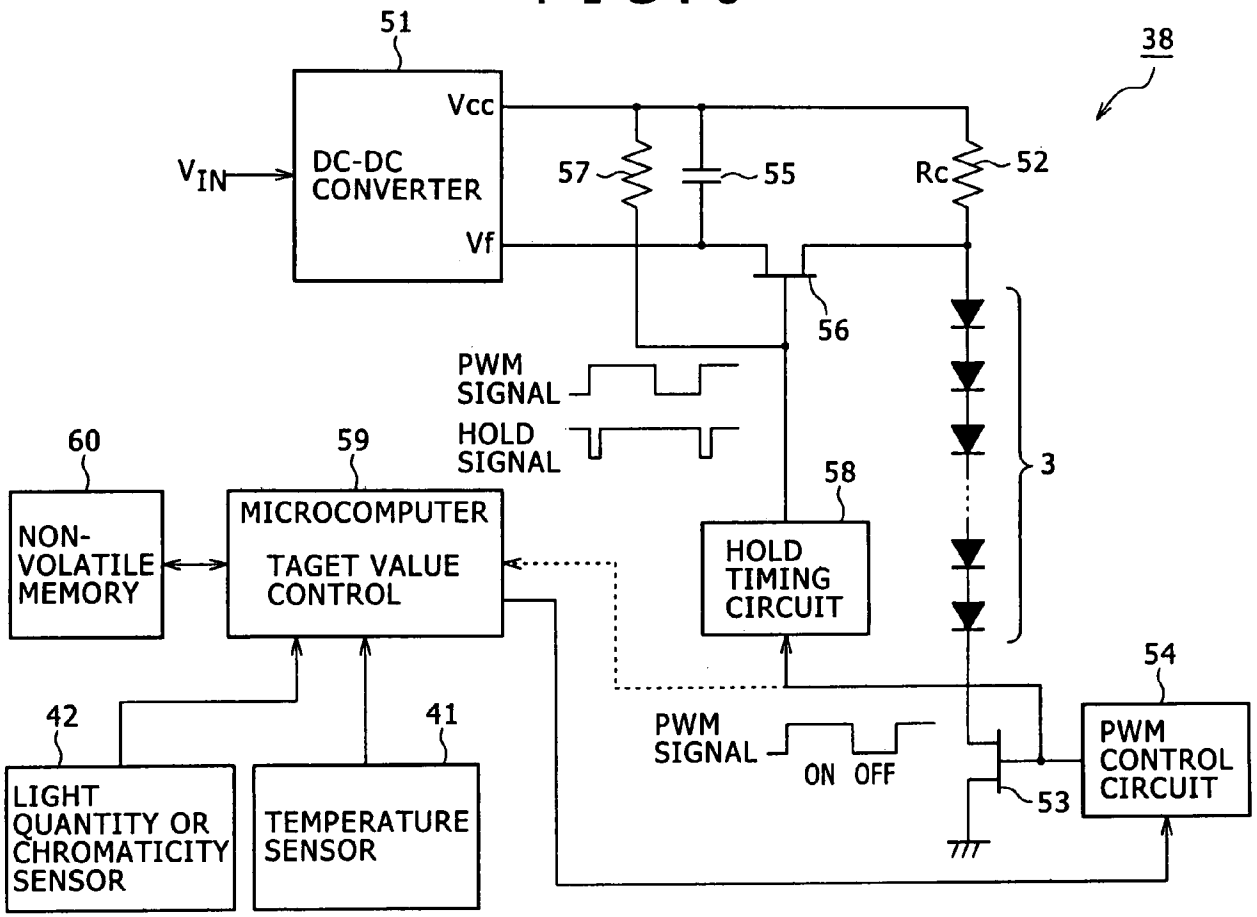
FIG. 6 is a diagram showing a backlight driving control unit for driving light emitting diodes.

Description will next be made of the backlight driving control unit 38 for driving the light emitting diodes 3 connected in series with each other in the horizontal direction. FIG. 6 shows an example of circuit configuration of the backlight driving control unit 38.

The backlight driving control unit 38 includes a DC-to-DC converter 51, a constant resistance (Rc) 52, a FET 53, a PWM control circuit 54, a capacitor 55, a sampling and holding FET 56, a resistance 57, a hold timing circuit 58, and a microcomputer 59 as a control unit.

The DC-to-DC converter 51 is supplied with a direct-current voltage VIN generated by the power supply 31 shown in FIG. 4, and generates a direct-current output voltage Vcc by switching and stabilizing the input direct-current power. The DC-to-DC converter 51 generates the stabilized output voltage Vcc so that a potential difference between a voltage input from a feedback terminal Vf and the output voltage Vcc is a constant value (Vref).

An anode side of the light emitting diodes 3 connected in series with each other is connected via the constant resistance (Rc) 52 to an output terminal of the DC-to-DC converter 51 which terminal outputs the output voltage Vcc. The anode side of the light emitting diodes 3 connected in series with each other is also connected to the feedback terminal of the DC-to-DC converter 51 via a source and a drain of the sampling and holding FET 56. A cathode side of the light emitting diodes 3 connected in series with each other is connected to a ground via a source and a drain of the FET 53.

A gate of the FET 53 is supplied with a PWM signal generated by the PWM control circuit 54. The FET 53 is turned on between the drain and the source when the PWM signal is on, and is turned off between the drain and the source when the PWM signal is off. Hence, the FET 53 passes a current through the light emitting diodes 3 when the PWM signal is on, and reduces the current flowing through the light emitting diodes 3 to zero when the PWM signal is off. That is, the FET 53 makes the light emitting diodes 3 emit light when the PWM signal is on, and stops the light emission of the light emitting diodes 3 when the PWM signal is off.

The PWM control circuit 54 generates the PWM signal, which is a binary signal whose duty ratio between an on time and an off time is adjusted. When the color liquid crystal display device 30 is turned on, the PWM control circuit 54 is supplied with an initially set duty ratio corresponding to each of the colors from the microcomputer 59, and adjusts the pulse width of the PWM signal so that the duty ratio of the PWM signal coincides with the initially set duty ratio. Also, when supplied with a target duty ratio set according to the actual light quantity or chromaticity of each of the colors R, G, and B from the microcomputer 59, the PWM control circuit 54 adjusts the pulse width of the PWM signal so that the duty ratio of the PWM signal coincides with the target duty ratio. That is, the PWM control circuit 54 controls the PWM signal such that when the present duty ratio is lower than the target duty ratio, the PWM control circuit 54 increases the pulse width at the on time to lengthen the light emission time of the light emitting diodes 3, and such that when the present duty ratio is higher than the target duty ratio, the PWM control circuit 54 decreases the pulse width to shorten the light emission time of the light emitting diodes 3.

The capacitor 55 is disposed between the output terminal and the feedback terminal of the DC-to-DC converter 51. The resistance 57 is connected to the output terminal of the DC-to-DC converter 51 and a gate of the sampling and holding FET 56.

The hold timing circuit 58 is supplied with the PWM signal, and generates a hold signal that is off for a predetermined time at a rising edge of the PWM signal and is on for other times.

The gate of the sampling and holding FET 56 is supplied with the hold signal output from the hold timing circuit 58. The sampling and holding FET 56 is on between the source and the drain when the hold signal is off, and is off between the source and the drain when the hold signal is on.

That is, in the backlight driving control unit 38, a current ILED flows through the light emitting diodes 3 only during the time when the PWM signal generated by the PWM control circuit 54 is on. The capacitor 55, the sampling and holding FET 56, and the resistance 57 form a sample and hold circuit. This sample and hold circuit samples a voltage value of the anode of the light emitting diodes 3 (that is, one terminal of the constant resistance (Rc) 52 which terminal is not connected to the output voltage Vcc) during the on time of the PWM signal, and supplies the voltage value to the feedback terminal of the DC-to-DC converter 51. The DC-to-DC converter 51 stabilizes the output voltage Vcc on the basis of the voltage value input to the feedback terminal of the DC-to-DC converter 51, so that a peak value of the current ILED flowing through the constant resistance (Rc) 52 and the light emitting diodes 3 is constant. Thus, in the backlight driving control unit 38, pulse driving is performed according to the PWM signal in a state in which the peak value of the current ILED flowing through the light emitting diodes 3 is constant.

When the color liquid crystal display device 30 is turned on, the microcomputer 59 reads a duty ratio at the time of initial setting of each color from a nonvolatile memory 60, and supplies the duty ratio to the PWM control circuit 54. The initial setting is for example performed by roughly setting the duty ratio and the peak value of the current ILED for the light emitting diodes 3 of each color, making the duty ratio and the peak value variable and adjusting the duty ratio and the peak value so as to attain a desired light quantity and a desired chromaticity, and storing the duty ratio of the light emitting diodes 3 of each color, the light quantity and the chromaticity of each color, and an output of the temperature sensor 41 at this time in the nonvolatile memory 60 in advance before shipment from a factory.

Further, in order to obtain predetermined white light, the microcomputer 59 fixes the duty ratio of the light emitting diodes 3 of any one color, and performs feedback control of the light emitting diodes 3 of the two other colors. The microcomputer 59 supplies a target duty ratio to the PWM control circuit 54 until a ratio of the light quantity or the chromaticity of each color detected by the light quantity or chromaticity sensor 42 coincides with a ratio at the time of initial setting (that is, until the chromaticity of white light obtained by mixing the R, G, and B light converges).

As described above, in the backlight driving control unit 38 having the microcomputer 59, the PWM signal is first generated with the duty ratio at the time of initial setting, and then the duty ratio is adjusted by feedback control so as to obtain predetermined white light while referring to the light quantity or the chromaticity of each color detected by the light quantity or chromaticity sensor 42.

The light emitting diodes are devices that degrade in brightness with time. In addition, speed of degradation varies not only between light emitting diodes of different colors but also between light emitting diodes of a same color, depending on variations at the time of manufacturing, the temperature of the light emitting diodes, the ambient temperature of an environment in which the backlight device 20 is disposed, and the like.

Hence, when the brightness is greatly degraded, and consequently a difference between the duty ratio at the time of initial setting which ratio is read from the nonvolatile memory 60 and the duty ratio after adjustment is increased, a time (converging time) required to read the duty ratio at the time of initial setting from the nonvolatile memory 60 and obtain predetermined white light by adjusting the duty ratio of the light emitting diodes 3 of the two other colors is lengthened. As a result, a phenomenon occurs in which the screen is reddish at the time of turning on power and thereafter gradually becomes white, for example. In addition, when the duty ratio of the light emitting diodes 3 is increased because of a degradation in brightness, a phenomenon occurs in which total backlight power is increased as compared with the initial setting.

This problem is true not only for degradation in brightness with time as described above but also for a case where variations in characteristics of the light emitting diodes 3 occur due to insufficient annealing or the like and a difference between the duty ratio at the time of initial setting and the duty ratio after adjustment becomes great.

Accordingly, the microcomputer 59 actually reads a predetermined multiplication coefficient set for each color from the nonvolatile memory 60 together with the duty ratio at the time of initial setting, corrects the duty ratio at the time of initial setting by multiplying the duty ratio at the time of initial setting by the read multiplication coefficient, and uses the duty ratio after the correction, whereby a time required to converge the chromaticity is shortened.

Figure 7:
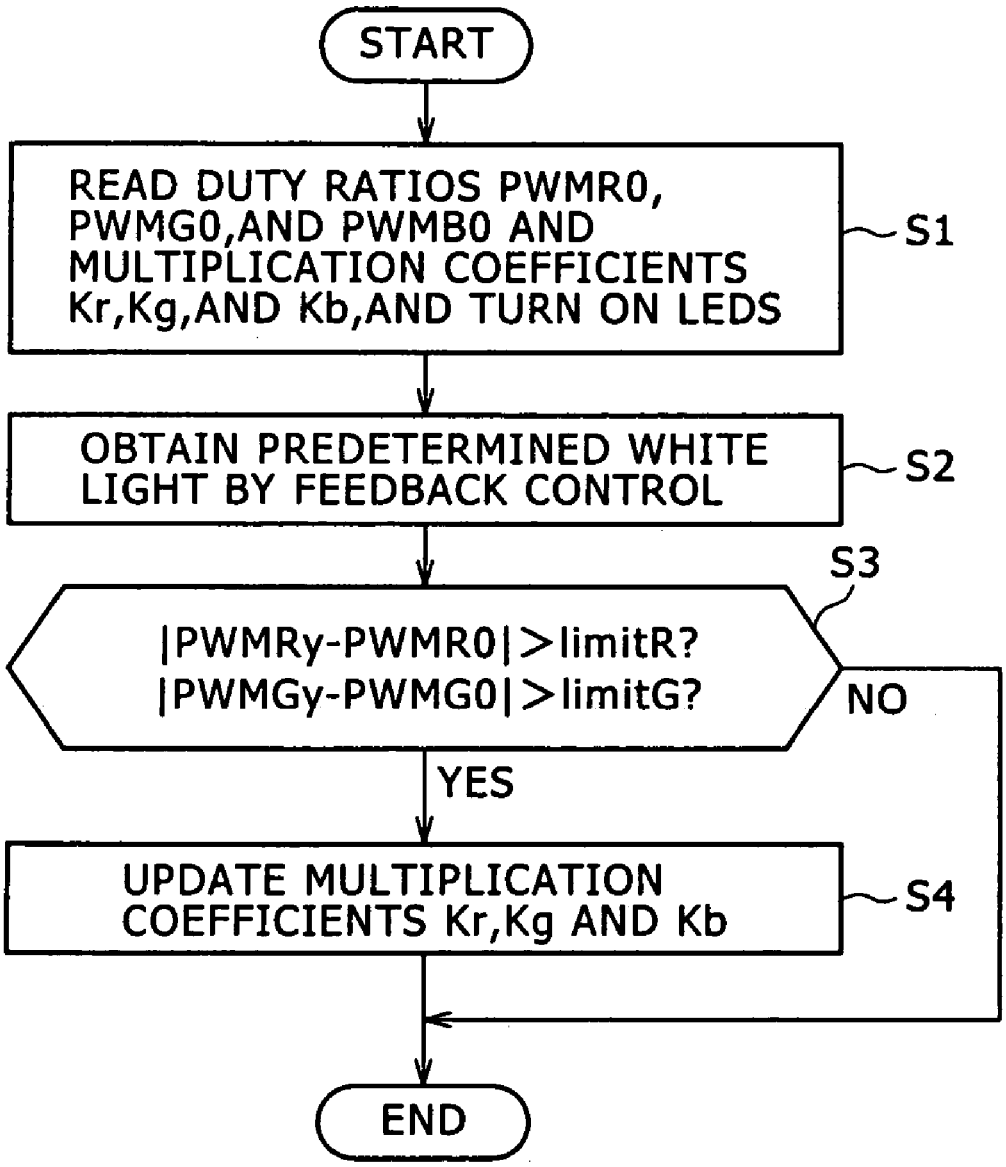
FIG. 7 is a flowchart of assistance in explaining a process of a microcomputer in the backlight driving control unit.

An example of a process of correcting the duty ratio will be described concretely with reference to a flowchart of FIG. 7. Incidentally, in adjusting the duty ratio so as to obtain predetermined white light, the duty ratio of the light emitting diodes 3 of any one color is fixed, and the duty ratio of the light emitting diodes 3 of the two other colors is adjusted. Since the blue light emitting diodes 3B is changed least in brightness and peak wavelength with temperature change, the duty ratio of the blue light emitting diodes 3B is fixed in this concrete example.

First, when the color liquid crystal display device 30 is turned on, the microcomputer 59 reads the duty ratios $PWM_{R0}$, $PWM_{G0}$, and $PWM_{B0}$ of the respective colors at the time of initial setting and predetermined multiplication coefficients Kr, Kg, and Kb set for the respective colors from the nonvolatile memory 60, multiplies the duty ratios $PWM_{R0}$, $PWM_{G0}$, and $PWM_{B0}$ by the multiplication coefficients Kr, Kg, and Kb, respectively, and supplies results of the multiplication to the PWM control circuit 54 (step S1). The initial values of the multiplication coefficients Kr, Kg, and Kb are one, and thus the duty ratios $PWM_{R0}$, $PWM_{G0}$, and $PWM_{B0}$ at the time of initial setting are initially supplied as they are to the PWM control circuit 54. The PWM control circuit 54 adjusts the pulse width of the PWM signal so as to attain coincidence with the supplied duty ratios.

Next, in order to obtain predetermined white light, the microcomputer 59 fixes the duty ratio $PWM_{B0}$ of the blue light emitting diodes 3B, and performs feedback control of the red and green light emitting diodes 3R and 3G. The microcomputer 59 changes the duty ratios of the red and green light emitting diodes 3R and 3G and supplies the duty ratios to the PWM control circuit 54 until a ratio of the light quantity or the chromaticity of each color detected by the light quantity or chromaticity sensor 42 coincides with a ratio at the time of initial setting (step S2). Suppose that as a result, the duty ratios of the respective colors are $PWM_{Rx}$, $PWM_{Gx}$, and $PWM_{B0}$ when the predetermined white light is obtained.

While such an adjusting process is performed, the light emitting diodes 3 are degraded in brightness as a result of repeated continued illuminations over long periods of time of the light emitting diodes 3. The microcomputer 59 changes the duty ratios so as to correct for this degradation in brightness. Suppose that as a result, the duty ratios of the respective colors after adjustment are $PWM_{Ry}$, $PWM_{Gy}$, and $PWM_{B0}$.

The microcomputer 59 compares absolute values of difference between the duty ratios $PWM_{Ry}$ and $PWM_{Gy}$ of the red and green light emitting diodes 3R and 3G and the duty ratios $PWM_{R0}$ and $PWM_{G0}$ at the time of initial setting with predetermined threshold values limitR and limitG. When the absolute values of difference between the duty ratios $PWM_{Ry}$ and $PWM_{Gy}$ of the red and green light emitting diodes 3R and 3G and the duty ratios $PWM_{R0}$ and $PWM_{G0}$ at the time of initial setting are higher than the predetermined threshold values limitR and limitG (step S3) as a result of degradation in brightness of the light emitting diodes 3, the microcomputer 59 updates the values of the multiplication coefficients Kr, Kg, and Kb (step S4).

An updating method is to fix the multiplication coefficient Kb at one and update the multiplication coefficients Kr and Kg according to ratios between the duty ratios $PWM_{R0}$ and $PWM_{G0}$ at the time of initial setting and the duty ratios $PWM_{Ry}$ and $PWM_{Gy}$ after adjustment.

However, in this case, since there is a possibility of an increase in the duty ratios of the light emitting diodes 3 and an increase in power consumption of the backlight as compared with the initial setting, all of the multiplication coefficients Kr, Kg, and Kb may be updated such that the increase in the power consumption is within 5%, for example. Incidentally, letting Vr, Vg, and Vb be total voltages of the illuminating light emitting diodes 3R, 3G, and 3B, respectively, and letting Ir, Ig, and Ib be current values of the illuminating light emitting diodes 3R, 3G, and 3B, respectively, the power consumption Power of the backlight can be roughly calculated by the following equation:

$$\text{Power}=Vr*PWM_R*Ir+Vg*PWM_g*Ig+Vb*PWM_b*Ib$$

In addition, after the multiplication coefficients Kr, Kg, and Kb are determined according to the ratios between the duty ratios $PWM_{R0}$, $PWM_{G0}$, and $PWM_{B0}$ at the time of initial setting and the duty ratios $PWM_{Rx}$, $PWM_{Gx}$, and $PWM_{B0}$ of the respective colors after adjustment, the multiplication coefficients Kr, Kg, and Kb may be corrected such that a maximum value thereof is one, to obtain new multiplication coefficients Kr, Kg, and Kb.

The backlight driving control unit 38 thus updates the values of the multiplication coefficients Kr, Kg, and Kb. Consequently, when the color liquid crystal display device 30 is turned on next, duty ratios approximate to final duty ratios after adjustment are supplied to the PWM control circuit 54 from the beginning. It is therefore possible to shorten the time required to converge the chromaticity.

It is to be noted that the present invention is not limited only to the foregoing embodiment, and that various changes may of course be made without departing from the spirit of the present invention.

For example, while in the foregoing embodiment, the initial set values and the multiplication coefficients of the respective colors are stored in the nonvolatile memory 60, the present invention is not limited to this, and the set values of the respective colors after adjustment may be stored as they are in the nonvolatile memory 60. In addition, the set value of a particular color and information on ratios of the set values of the other colors to the set value of the particular color, for example, may be stored in the nonvolatile memory 60. That is, as long as data of each color which data is applied to reduce the time required to converge the chromaticity when power is turned on can be reproduced, the data may be stored in the nonvolatile memory 60 in any form.

It should be understood by those skilled in the art that various modifications, combinations, sub-combinations and alterations may occur depending on design requirements and other factors insofar as they are within the scope of the appended claims or the equivalents thereof.

The invention claimed is:

1. A backlight driving device for controlling driving of a backlight device for display, said backlight device generating predetermined white light by mixing light from a plurality of light emitting diodes of three or more colors, said backlight driving device comprising:

storing means for storing an initial amount of current and a predetermined multiplication coefficient for each color;

light quantity detecting means for detecting a light quantity for each color; and controlling means for adjusting an amount of current passed through said light emitting diodes of each color by feedback control on a basis of a detection output from said light quantity detecting means with an amount of current obtained by multiplying said initial amount of current by said predetermined multiplication coefficient as an initial value, whereby said predetermined white light is generated;

wherein when a difference between the amount of current after the feedback control and said initial amount of current exceeds a predetermined threshold value, said controlling means updates said multiplication coefficient according to the amount of current after said feedback control.

2. The backlight driving device as claimed in claim 1, wherein said controlling means fixes an amount of current passed through light emitting diodes of one of the colors, and adjusts an amount of current passed through light emitting diodes of the other colors by the feedback control.

3. The backlight driving device as claimed in claim 1, wherein said controlling means sets a multiplication coefficient for one of the colors at one, and updates multiplication coefficients for the other colors.

4. The backlight driving device as claimed in claim 1, wherein said controlling means updates said multiplication coefficient such that a backlight power consumption is a predetermined amount or less.

5. The backlight driving device as claimed in claim 1, wherein said controlling means updates said multiplication coefficient such that a maximum value of multiplication coefficients for a plurality of colors is one.

6. A backlight driving method for controlling driving of a backlight device for display, said backlight device generating predetermined white light by mixing light from a plurality of light emitting diodes of three or more colors, said backlight driving method comprising:

a reading step for reading an initial amount of current and a predetermined multiplication coefficient stored for each color from storing means;

a light quantity detecting step for detecting a light quantity for each color;

a controlling step for adjusting an amount of current passed through said light emitting diodes of each color by feedback control on a basis of a detection output in said light quantity detecting step with an amount of current obtained by multiplying said initial amount of current by said predetermined multiplication coefficient as an initial value, whereby said predetermined white light is generated; and an updating step for updating said multiplication coefficient according to the amount of current after said feedback control when a difference between the amount of current after said feedback control and said initial amount of current exceeds a predetermined threshold value.

7. A liquid crystal display device comprising:

a backlight device for generating predetermined white light by mixing light from a plurality of light emitting diodes of three or more colors, said backlight device being driven by a backlight driving device; and a transmissive type color liquid crystal display panel irradiated with the white light generated by said backlight device from a back side of the transmissive type color liquid crystal display panel;

wherein said backlight driving device includes storing means for storing an initial amount of current and a predetermined multiplication coefficient for each color, light quantity detecting means for detecting a light quantity for each color, and controlling means for adjusting an amount of current passed through said light emitting diodes of each color by feedback control on a basis of a detection output from said light quantity detecting means with an amount of current obtained by multiplying said initial amount of current by said predetermined multiplication coefficient as an initial value, whereby said predetermined white light is generated, and when a difference between the amount of current after the feedback control and said initial amount of current exceeds a predetermined threshold value, said controlling means updates said multiplication coefficient according to the amount of current after said feedback control.

8. A backlight driving device for controlling driving of a backlight device for display, said backlight device generating predetermined white light by mixing light from a plurality of light emitting diodes of three or more colors, said backlight driving device comprising:

a storing section storing an initial amount of current and a predetermined multiplication coefficient for each color;

a light quantity detector detecting a light quantity for each color; and a controller adjusting an amount of current passed through said light emitting diodes of each color by feedback control on a basis of a detection output from said light quantity detector with an amount of current obtained by multiplying said initial amount of current by said predetermined multiplication coefficient as an initial value, whereby said predetermined white light is generated;

wherein when a difference between the amount of current after the feedback control and said initial amount of current exceeds a predetermined threshold value, said controller updates said multiplication coefficient according to the amount of current after said feedback control.

* * * * *